US008100707B2

(12) United States Patent
Kussel et al.

(10) Patent No.: US 8,100,707 B2
(45) Date of Patent: Jan. 24, 2012

(54) PLUG CONTACT PAIRING

(75) Inventors: Willi Kussel, Werne (DE); Peter Rahms, Billerbeck (DE)

(73) Assignee: Tiefenbach Control Systems (DE)

( * ) Notice: Subject to any disclaimer, the term of this patent is extended or adjusted under 35 U.S.C. 154(b) by 0 days.

(21) Appl. No.: 12/664,568

(22) PCT Filed: May 6, 2008

(86) PCT No.: PCT/DE2008/000761

§ 371 (c)(1),
(2), (4) Date: Sep. 22, 2010

(87) PCT Pub. No.: WO2008/138303

PCT Pub. Date: Nov. 20, 2008

(65) Prior Publication Data

US 2011/0028022 A1 Feb. 3, 2011

(30) Foreign Application Priority Data

May 12, 2007 (DE) ..... 10 2007 022 598
May 12, 2007 (DE) ..... 10 2007 022 600

(51) Int. Cl.
*H01R 13/52* (2006.01)

(52) U.S. Cl. ..... 439/271; 439/349

(58) Field of Classification Search ..... 439/271, 439/349, 378, 651, 680, 903
See application file for complete search history.

(56) References Cited

U.S. PATENT DOCUMENTS

| | | | | |
|---|---|---|---|---|
| 2,761,111 | A * | 8/1956 | Klostermann | 439/271 |
| 3,793,610 | A * | 2/1974 | Brishka | 439/349 |
| 7,396,249 | B2 * | 7/2008 | Kauffman | 439/349 |
| 7,422,463 | B2 * | 9/2008 | Kuo | 439/349 |
| 7,789,667 | B2 * | 9/2010 | Zhu et al. | 439/39 |
| 2004/0166744 | A1 | 8/2004 | Inaba et al. | |
| 2007/0054534 | A1 | 3/2007 | Kauffman | |

FOREIGN PATENT DOCUMENTS

| | | |
|---|---|---|
| DE | 1 515 685 | 7/1970 |
| DE | 199 42 921 | 4/2001 |
| GB | 2 161 996 | 1/1986 |
| WO | WO 2004/075349 | 9/2004 |

OTHER PUBLICATIONS

International Search Report for International Application No. PCT/DE2008/000761.

* cited by examiner

*Primary Examiner* — Thanh Tam Le
(74) *Attorney, Agent, or Firm* — Alston & Bird LLP

(57) ABSTRACT

A plug contact pairing comprises a plug pot with contact pins, as well as a plug head with contact circuits for connection of electrical line ends. A profiled ring (securing ring) is used to mount the plug head in an interlocking manner in the plug pot, is incorporated with a part of its cross section in a circumferential groove in the plug head and, during closure of the plug contact pairing, latches with the rest of its cross section into a groove on the internal circumference of the plug pot. By virtue of the shape and material of the securing ring and the slot shape, the plug head can be pulled out of the plug pot only with a tensile force which is greater than the limit value. In one development, the plug head is mounted with an identical connection in the plug housing, in which case the mounting ring connection is designed in comparison to the securing ring connection such that the tensile force with which the plug head can be pulled out of the plug pot is less than that by means of which the plug head is held in the plug housing by the mounting ring connection.

6 Claims, 2 Drawing Sheets

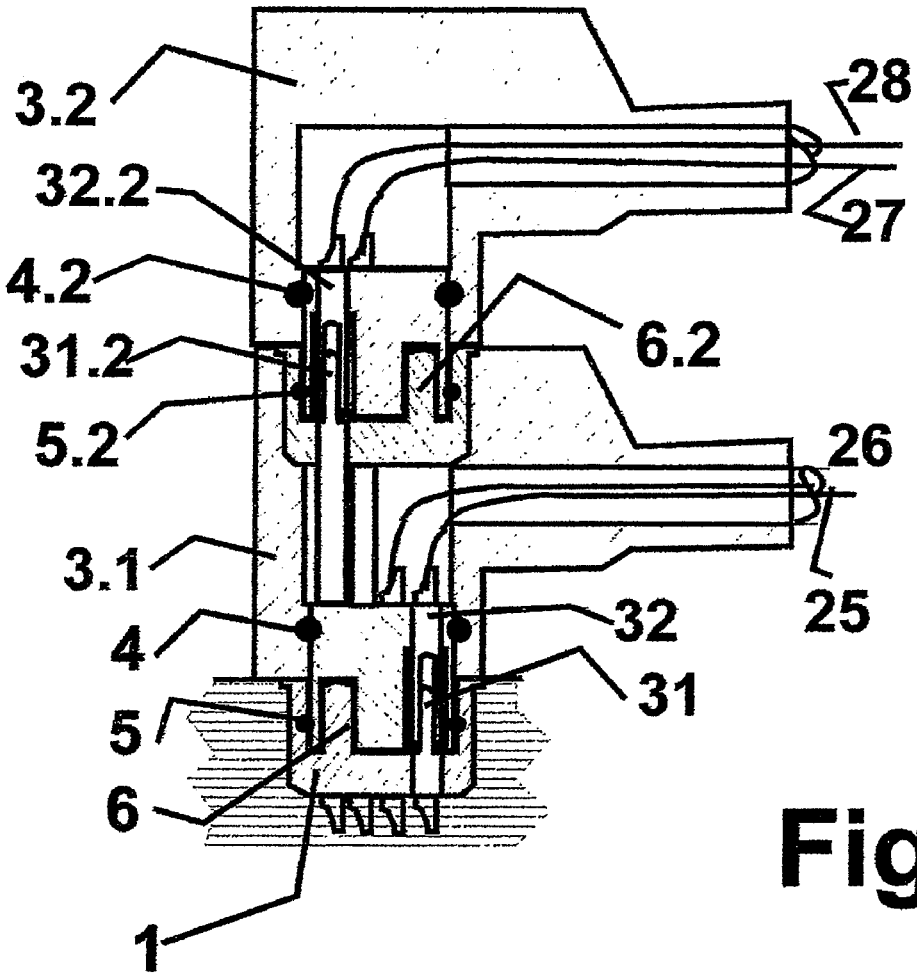
Fig.2
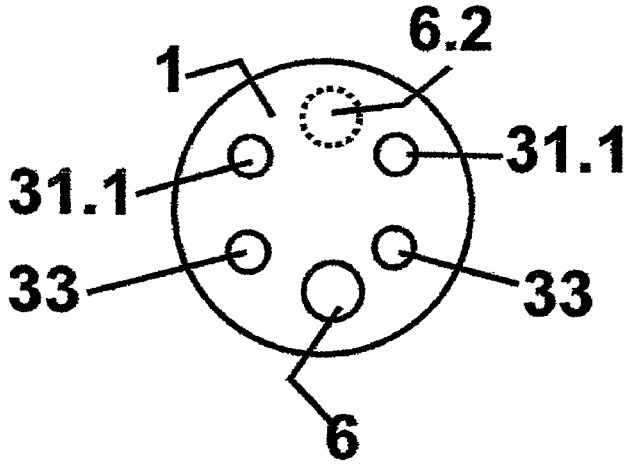

PLUG CONTACT PAIRING

BACKGROUND OF THE INVENTION

1. Field of the Invention

The invention concerns a plug contact pair.

2. Description of Related Art

A plug contact pairing has general usage and is commercially available. It has a cylindrical, mostly circular cylindrical plug receptacle firmly mounted in a machine housing by, for example, screws, and contact pins in the interior of the plug receptacle. The contact pins are parallel with the axis of the receptacle. The movable part of the plug contact has a plug head with contact bushes. Contact pins and contact bushes are joined, for example, soldered, to the ends of electric leads. In this application as machine housing any housing is understood, that accommodates an electrical or electronic equipment, for example electronic computers or electronic control device and is detachably connected with another electrical or electronic equipment, be it a current source or current consumer. To prevent an unintentional pulling out of the plug head from the plug receptacle or falling out due to, for example, vibration, instead of a friction-locked fastening in most cases a form-locked fastening of the plug head in the plug receptacle is provided by, for example, screwing them together in the inserted state. When pulling out the movable plug part from the stationary part this fastening is often troublesome and there is the danger of the detaching being carried out improperly or even leading to damages.

SUMMARY OF VARIOUS EMBODIMENTS

According to one embodiment the object of the invention is to provide a fastening that is simple to produce, yet is secure and simple to detach.

The further development according to another embodiment has the advantage that the movable plug part, namely the plug head, is also reliably fastened in its plug housing, that the fastenings of the plug head in the plug receptacle on the one hand and in the plug housing on the other are so harmonised that the function of the detachable plug is ensured and can be executed without damaging the plug.

The further development according to another embodiment is intended for all plug contact pairings according to the present invention, in particular however for the execution according to certain embodiments, since it is a simple yet secure construction with small dimensions of a plurality of plug contact pairings for an electronic equipment.

The further development according to another embodiment has the advantage that the second movable plug part, namely the plug head, can be also simply and reliably inserted into the stationary part of the second pairing.

The further development according to another embodiment is particularly space-saving and therefore can be used for very small electronic equipment.

BRIEF DESCRIPTION OF THE SEVERAL VIEWS OF THE DRAWINGS

The invention is described in the following based on the drawing of embodiments.

They show in:

FIG. 2—a double plug contact pairing.

DETAILED DESCRIPTION

Figure 1:
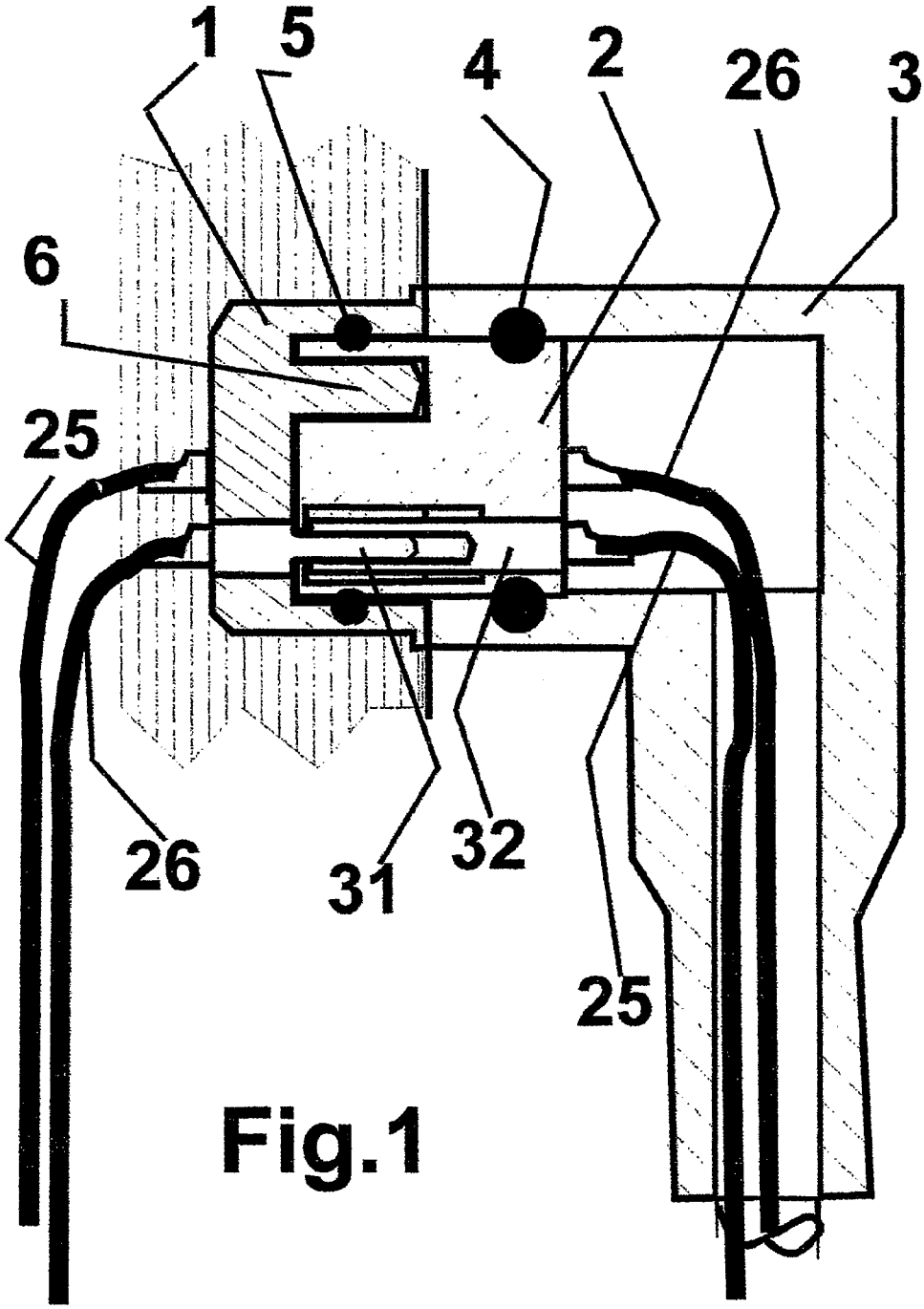
FIG. 1—a simple plug contact pairing.

The Following Description Applies to Both Figures:

The plug head 1 of the plug contact pairing is firmly mounted in the housing of an electrical equipment machine housing. In its cylindrical interior it has contact pins 31, that are parallel with the axis of the plug receptacle, pass through the bottom of the receptacle and protrude into the interior of the plug head. The ends of the leads 25, 26 are soldered to the ends of the contact pins which protrude from the bottom of the receptacle, facing away from the bottom of the receptacle. The shape of movable plug head 2 corresponds to the interior of the plug receptacle. It has contact bushes 32 aligned parallel with the axis of its cylinder, the contact bushes having the same geometric arrangement as the contact pins in the plug head and are brought into contact by inserting the plug head into the plug receptacle. Because the contact pins and the contact bushes are asymmetrically distributed, a guide pin 6 protrudes parallel with the contact pins into the interior of the receptacle and in the geometrical identical position the plug head has a guide bore 7. The free ends of the contact bushes, facing away from the insertion openings, are soldered to the ends of the electrical leads 25, 26. The electrical leads 25, 26 are guided in the plug housing, facing away from the plug head. That portion of the plug head, which in the inserted state protrudes past the edge of the plug receptacle, is fastened in the interior of the plug housing that is so far congruent.

This is achieved by a form-locked fastening. For this purpose a profiled ring, preferably an O-ring, designated as fastening ring 4, with a portion of its section is placed into a circumferential groove on the external circumference at that end of the plug head which is accommodated in the interior of the plug housing. The remainder the section of the fastening ring 4 engages a groove on the internal circumference of the plug housing, while the cross-sectional plane of the plug head, in which the groove is situated, determines the depth of insertion of the plug head in the plug housing.

For a form-locked fastening after the insertion of the plug head into the plug receptacle a further profiled ring, preferably an O-ring, is used, that is designated as retaining ring 5. Part of its cross-section is embedded in a circumferential groove of the plug head and during the insertion of the plug head into the plug receptacle the retaining ring 5 engages with the rest of its cross-section a groove on the internal circumference of the plug receptacle. By doing so, this retaining ring connection, including the grooves and the retaining ring 5, is so constructed with regard to shape and material, that the movable plug head 2 can be pulled out from the plug receptacle 1 mounted in the machine frame only by using a tensile force that exceeds a boundary value. In particular the unintentional falling out of the plug head from the plug receptacle or without human interference is to be avoided.

On the other hand the fastening of the plug head 2 in the plug housing 3 by the fastening ring 4 is even "sturdier"; i.e. the fastening ring connection between the plug housing and the plug head, including the grooves and the ring 4 with regards to shape, material and shape of the groove, when compared with the retaining ring connection, including grooves and the ring 5, is so designed that the tensile force, with which the plug head can be pulled out from the plug receptacle, is smaller than that holding the plug head in the plug housing by means of the fastening ring connection. That will also prevent that, when trying to pull out the plug head from the plug receptacle, the plug housing would be inadvertently pulled off the plug head and due to this the ends of the leads, possibly the ends of the contact bushes, would be torn off.

For FIG. 2 the Following Additional Description Applies:

The plug housing 3.1 of the first plug contact pairing comprises the stationary part, i.e. the plug head 2.1 of a second plug contact pairing. In the example it is identically constructed with the first one containing the parts 2.2 instead of 2, plug head 1.1 instead of 1, housing 3.1 instead of 3, leads/ends of leads 27, 28 in addition to leads/ends of leads 25, 26, contact pins 31.2 instead of 31, contact bushes 32.2 instead of 32, fastening ring 4.2 instead of 4, retaining ring 5.2 instead of 5.

The Following Peculiarities are Particularly Valid for the Embodiment:

The inserting directions are the same for both pairings.

The exit directions of the ends of the leads 27, 28 and of the ends of the lines 25, 26 are in the same direction.

The first plug contact pairing has lead connections to the contact bushes 32.2 and contact pins 32.2 of the second plug contact pairing. For this purpose in the embodiment the plug receptacle and plug head of the first plug contact pairing have holes 33 for the contact pins 31.2 of the second plug contact pairing that are fastened with the appropriate length in the plug head 2.1 of the second plug contact pairing.

The plug receptacle 2.1 is firmly mounted in the plug housing 3.1 of the first plug contact pairing in a recess provided for this purpose.

The guide pins 6, 6.2 and guide bores are offset relative one another.

The invention claimed is:

1. A plug contact pairing comprising:

a plug receptacle including contact pins in an interior of the plug receptacle; and a plug head with contact bushes for the connection of electrical lead ends, wherein a form-locked fastening of the plug contact pairing forms when the plug head and the plug receptacle are in the inserted state, wherein the form-locked fastening of the plug contact pairing comprises a profiled ring (fastening ring), wherein a portion of the fastening ring is placed into a circumferential fastening ring groove of the plug head and when the plug contact pairing is closed to form a fastening ring connection, a remaining portion of the fastening ring engages a fastening ring groove on an internal circumference of the plug receptacle, wherein the fastening ring connection including said fastening ring grooves and the fastening ring with regards to shape and material of the fastening ring as well as the shape of said fastening ring grooves is so constructed that the plug head can be pulled out from the plug receptacle only with a tensile force that exceeds a boundary value, and wherein the plug head inserted with one end into a congruent end of a plug housing is fastened in a form-locked manner by a second profiled ring (retaining ring), wherein a portion of the retaining ring is placed into a circumferential retaining ring groove on an external circumference of said one end of the plug head and wherein a remaining portion of the retaining ring engages a retaining ring groove on an internal circumference of the plug housing when the plug head and plug housing form a retaining ring connection, wherein the fastening ring connection, including said fastening ring grooves and the fastening ring with regards to shape, material and shape of said fastening ring grooves, when compared with the retaining ring connection, is so constructed that the tensile force, with which the plug head can be pulled out from the plug receptacle, is smaller than that holding the plug head in the plug housing by means of the retaining ring connection.

2. A plug contact pairing according to claim 1, wherein the plug receptacle with contact pins is cylindrical, wherein the plug head with the contact bushes to connect ends of leads is cylindrical, said plug head having an external cross-section that is congruent with an internal cross-section of the plug receptacle and in the closed state of the plug contact pairing, a portion of the plug head fits into the plug receptacle and a remaining portion of the plug head is enclosed by the plug housing, while the plug receptacle with the contact pins is firmly mounted in a machine housing, wherein the plug housing contains a stationary portion of a second plug contact pairing for contacting additional leads/ends of the leads.

3. A plug contact pairing according to claim 1, further comprising a cylindrical plug receptacle of a second plug contact pairing with second contact pins mounted in the plug housing of the plug contact pairing, said second contact pins producing a connection to the electrical lead ends via the contact bushes and the contact pins of the plug contact pairing.

4. A plug contact pairing according to claim 3, wherein the direction of insertion of the plug contact pairing is the same as that of the second plug contact pairing.

5. The plug contact pairing according to claim 3, wherein the profiled ring (fastening ring) comprises an O-ring.

6. The plug contact pairing according to claim 1, wherein the second profiled ring (retaining ring) comprises an O-ring.

* * * * *